US005893493A

United States Patent [19]

Noiray

[11] Patent Number: 5,893,493

[45] Date of Patent: Apr. 13, 1999

[54] FOLDABLE CLOTHES HANGER

[76] Inventor: Jean-Luc G. Noiray, 368 Via Colinas, Westlake Village, Calif. 91362

[21] Appl. No.: 09/031,113

[22] Filed: Feb. 26, 1998

[51] Int. Cl.[6] ..... A47G 25/40; A47G 25/14

[52] U.S. Cl. ..... 223/94; 223/89

[58] Field of Search ..... 223/94, 92, 89, 223/88, 85

[56] References Cited

U.S. PATENT DOCUMENTS

| | | | |
|---|---|---|---|
| D. 259,228 | 5/1981 | Fabian | D6/124 |
| D. 263,013 | 2/1982 | Angeles | D6/250 |
| D. 309,834 | 8/1990 | Passini | D6/318 |
| D. 349,410 | 8/1994 | Morales-Rivera | D6/316 |
| D. 363,339 | 10/1995 | Rohacek | D22/199 |
| D. 886,041 | 4/1908 | Dawson . | |
| 1,117,436 | 11/1914 | Person . | |
| 1,193,357 | 8/1916 | Buxton | 223/94 |
| 1,278,054 | 9/1918 | Strand . | |
| 1,374,024 | 4/1921 | Morton . | |
| 1,458,114 | 6/1923 | Sommer . | |
| 1,570,196 | 1/1926 | Barron | 223/89 |
| 1,955,995 | 4/1934 | Wood | 223/65 |
| 2,108,622 | 2/1938 | Strezoff | 223/89 |
| 2,137,700 | 11/1938 | Reehl | 223/94 |
| 2,290,722 | 7/1942 | Weingarten | 223/94 |
| 2,354,099 | 7/1944 | Bess | 223/86 |
| 2,420,116 | 5/1947 | Walters | 223/89 |
| 2,425,527 | 8/1947 | Gaudino | 223/94 |
| 2,509,754 | 5/1950 | Badalamenti | 223/94 |
| 2,707,070 | 4/1955 | Tanzer | 223/94 |
| 3,645,426 | 2/1972 | Glascock et al. | 223/89 |
| 3,703,978 | 11/1972 | Sammartino et al. | 223/89 |
| 3,705,673 | 12/1972 | Mohammar | 223/94 |
| 3,790,046 | 2/1974 | Rooney | 223/92 |
| 3,792,776 | 2/1974 | Kenison | 223/89 |
| 3,802,610 | 4/1974 | Love et al. | 223/94 |
| 3,858,770 | 1/1975 | Murray | 223/94 |
| 3,874,572 | 4/1975 | McClenning | 223/94 |
| 3,920,127 | 11/1975 | LaBeaud | 211/118 |
| 3,966,100 | 6/1976 | Nelson | 223/92 |
| 4,004,721 | 1/1977 | Ross | 223/89 |
| 4,186,857 | 2/1980 | Helms, Jr. | 223/94 |
| 4,231,499 | 11/1980 | Smith | 223/94 |
| 4,300,688 | 11/1981 | London et al. | 206/286 |
| 4,523,701 | 6/1985 | Armbruster | 223/94 |
| 4,524,890 | 6/1985 | Fulton | 223/94 |
| 4,813,581 | 3/1989 | LaMont | 223/94 |
| 4,915,271 | 4/1990 | Champagne | 223/69 |
| 4,948,019 | 8/1990 | Rodum | 223/94 |
| 4,997,115 | 3/1991 | Jolley | 223/89 |
| 5,007,562 | 4/1991 | Brink et al. | 223/94 |
| 5,044,534 | 9/1991 | Hwang | 223/94 |
| 5,085,357 | 2/1992 | Chen | 223/89 |
| 5,183,190 | 2/1993 | Zuckerman | 223/96 |
| 5,397,037 | 3/1995 | Ozawa | 223/94 |
| 5,480,076 | 1/1996 | Siegel et al. | 223/94 |
| 5,590,823 | 1/1997 | Lunde | 223/94 |
| 5,598,957 | 2/1997 | Bell | 223/94 |

*Primary Examiner*—Bibhu Mohanty
*Attorney, Agent, or Firm*—Christie, Parker & Hale, LLP

[57] ABSTRACT

A foldable and collapsible hanger includes a pair of articulated upper branches pivotally coupled to, and extending from, opposite sides of a central hub which carries a hook. An articulated lower branch is pivotally coupled to, and extends between, distal ends of the upper branches to form a conventional hanger when deployed. The hanger may be folded along joints present in the upper and lower branches into a compact configuration that facilitates easy storage of the hanger.

16 Claims, 6 Drawing Sheets

FOLDABLE CLOTHES HANGER

FIELD OF THE INVENTION

The present invention relates generally to garment hangers, and more particularly to an improved collapsible and foldable clothes hanger.

BACKGROUND OF THE INVENTION

A conventional clothes hanger is typically an integrally formed rigid structure having a hook, a pair of downwardly angled upper members extending in opposite directions from the hook, and a lower transverse member extending between the upper members. The shoulders of a garment, such as a coat or jacket, may be draped over the upper members of the hanger to suspend the garment from the hanger in a generally upright orientation so as to reduce the risk of wrinkling or creasing garment. Additionally, garments such as pants or trousers may be draped over the lower member to similarly reduce the risk of wrinkling or creasing of the garments.

Conventional clothes hangers are, however, relatively wide, and are therefore not convenient for carrying in a suitcase, briefcase, travel bag, purse or the like, when traveling or needing to change clothes when away from home. For example, it is often difficult to extract a conventional clothes hanger from a travel bag. The hanger may rumple or otherwise damage the surrounding clothes or other items in the bag. Additionally, the exposed hook of the hanger frequently becomes entangled with the other items in the bag.

For these reasons, a variety of collapsible and foldable clothes hangers have been proposed in the past which are foldable into a relatively compact unit for storage and transportation, and which may be deployed to form a conventional hanger when needed. An exemplary embodiment of one such prior art foldable clothes hanger is disclosed in U.S. Pat. No. 2,420,116 to Walters. However, the foldable clothes hanger disclosed in Walters has several disadvantages, that are typical of the problems associated with the prior art in general. For example, when the hanger disclosed in Walters is collapsed, some of the components (e.g. the chain members) of the hanger remain loose and may become entangled with other items or objects. Additionally, the hook remains exposed when the hanger is collapsed, and thus may easily catch on other items or objects when inserted or removed from a travel bag. Moreover, in the case of metal hangers, the exposed hook of the hanger might be potentially dangerous in certain situations.

U.S. Pat. No. 5,044,534 to Hwang discloses another prior art foldable clothes hanger. In order to collapse the hanger in Hwang, however, a connection on the lower branch must first be disengaged, in order to separate this component into two distinct pieces.

U.S. Pat. No. 5,007,562 to Brink et al. also discloses a prior art foldable clothes hanger. However, in the Brink et al. design, the receptacle bearing the hook protrudes downward and significantly extends into the hanger triangle. As a result, this is little space between the hanger and the receptacle, which would make hanging pants or trousers on the lower branch somewhat difficult. Additionally, the protruding receptacle increases the likelihood that a pant cuff would be snagged when removing pants from the hanger.

Consequently, as a result of these and other disadvantages associated with the prior art, a need exists for an improved foldable garment hanger.

SUMMARY OF THE INVENTION

The present invention, therefore, provides an improved foldable and collapsible hanger designed to minimize the disadvantages associated with the prior art. The hanger includes a pair of articulated upper branches extending from opposite sides of a central hub, and an articulated lower branch extending between lower ends of the upper branches. A locking member is provided on the lower branch for securing the lower branch into a rigid bar when the hanger is deployed.

In one embodiment, each of the upper branches has at least one joint along its length and the lower branch has at least two joints along its length. More particularly, each upper branch includes a first upper section pivotally coupled to a respective side of the hub, a second upper section pivotally coupled to one end of the lower branch, and a connector positioned between, and pivotally coupled to, the first and second sections of the upper branch. The lower branch includes a first end section pivotally coupled to one of the upper branches, a second end section pivotally coupled to the other upper branch, and a middle section positioned between, and pivotally coupled to, the first and section sections of the upper branch.

To collapse and fold the hanger, the locking member is slid toward one of the end sections of the lower branch. The second upper members are pivoted so they are parallel to the end sections of the lower branch. Then each end section is pivoted relative to the middle section of the lower branch so that it is perpendicular to the middle section. The hanger thus has a closed compact configuration when collapsed to facilitate carrying the hanger in a bag or other container.

BRIEF DESCRIPTION OF THE DRAWINGS

These and other features and advantages of the present invention will be appreciated as the same become better understood by reference to the following Detailed Description when considered in connection with the accompanying drawings, wherein.

DETAILED DESCRIPTION OF THE INVENTION

Figure 1:
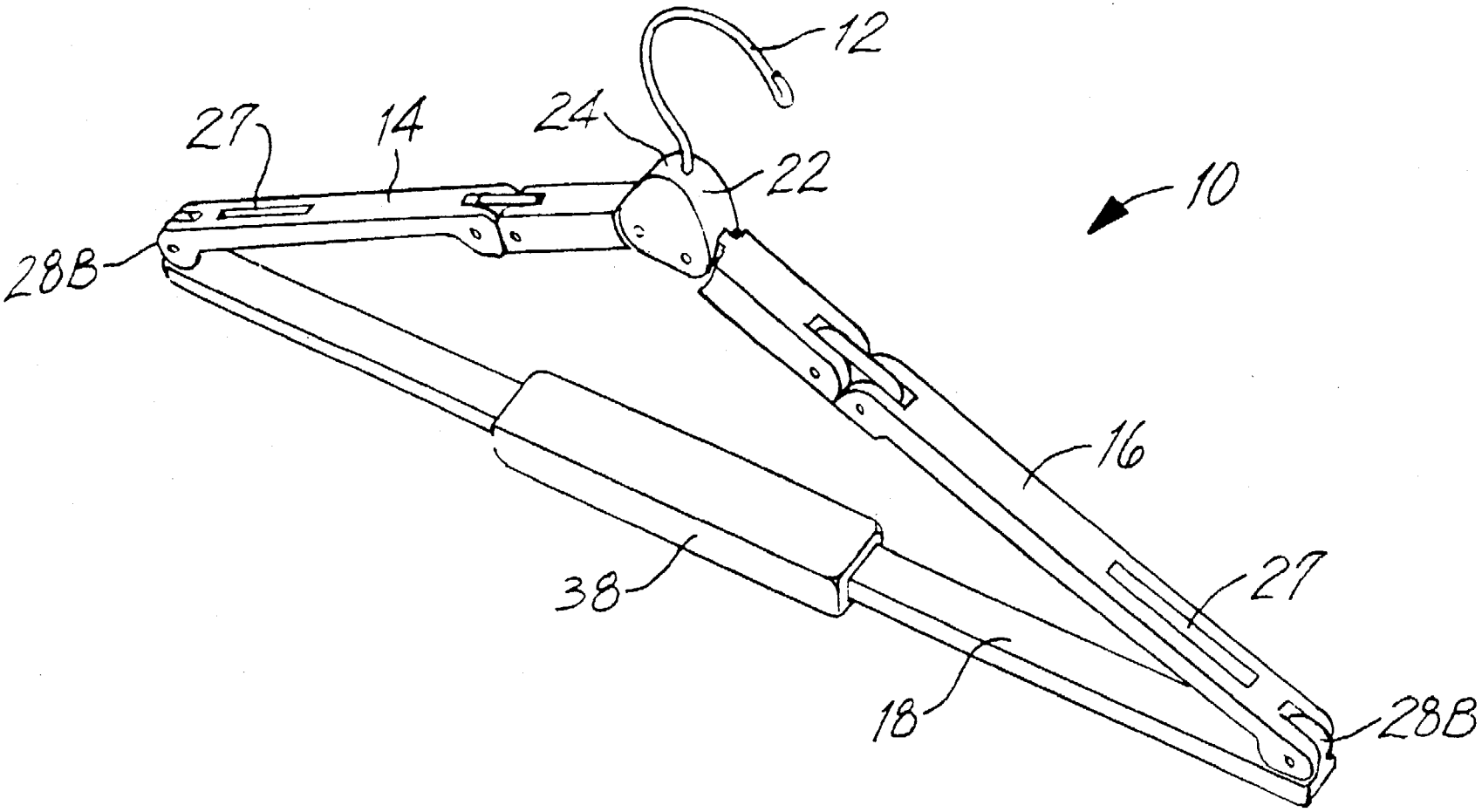
FIG. 1 is a perspective view of a foldable hanger according to the present invention.
Figure 2:
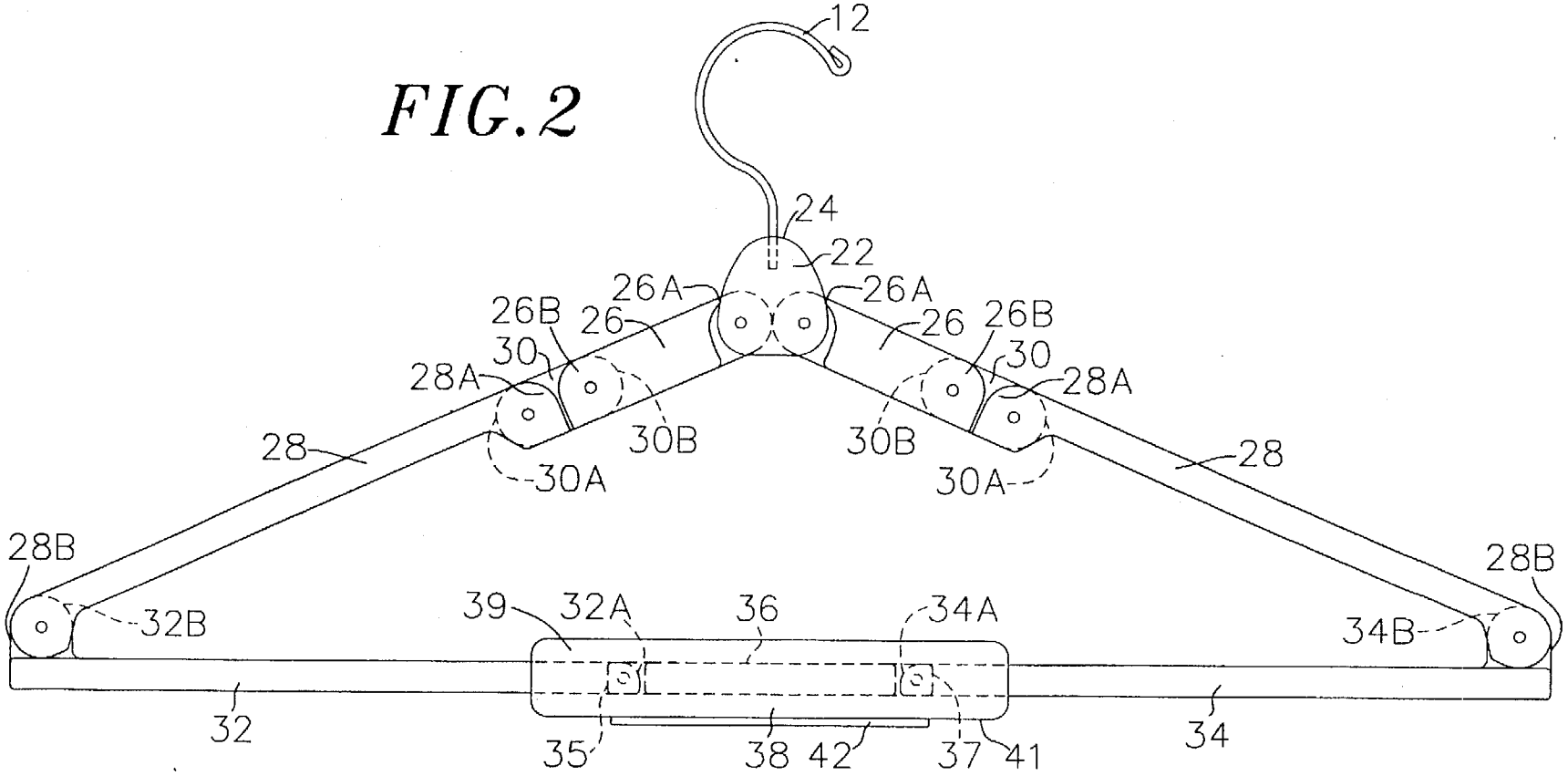
FIG. 2 is a front elevational view of the foldable hanger of FIG. 1 in a deployed state.

Referring now to FIGS. 1 and 2, a foldable hanger 10 constructed according to the teachings of the present invention is generally illustrated in a fully deployed state. A hook 12 is provided for suspending the hanger from a bar, rod, or other suitable support means when deployed. The hanger has a generally triangular shape, formed from a pair of downwardly angled upper branches 14, 16 extending in opposite directions from the hook, and a transverse lower branch 18 extending between distal ends 28B of the upper branches 14, 16. The hanger 10 also includes a central hub 22 located between the upper branches 14, 16. The hook 12 is anchored or otherwise secured into an upper surface 24 of the central hub.

In the fully deployed state illustrated in FIGS. 1 and 2, the configuration and dimensions of hanger 10 are substantially identical to those of a conventional clothes hanger. For example, in one embodiment of the present invention, when fully deployed the lower branch is about 42.5 centimeters and each of the upper members are about 23.5 centimeters. Yet, when fully collapsed and folded, the hanger only occupies a space of about 18.25 centimeters by 8 centimeters. It will be understood that these dimensions are by way of example only, and other dimensions may be used in alternate embodiments.

In order to facilitate collapsing and folding of the hanger 10, the upper branches 14, 16 and the lower member 18 of the hanger are constructed as articulated members. In a presently preferred embodiment, each of the upper branches has at least one joint along its length and the lower branch has at least two joints along its length. Additional joints are created at the intersection between the lower branch and each upper branch, and at the intersection between the central hub and each upper branch.

In the presently preferred embodiment illustrated in FIGS. 1 and 2, each of the upper branches includes a first upper section 26 pivotally coupled at end 26A to a respective side of the hub, a second upper section 28 pivotally coupled at end 28B to a respective end of the lower branch, and a connector section 30 positioned between the upper sections 26 and 28. More particularly, end 26B of the first section 26 is pivotally coupled to end 30B of the connector, and end 28A of the second section is pivotally coupled to end 30A of the connector.

Figure 6:
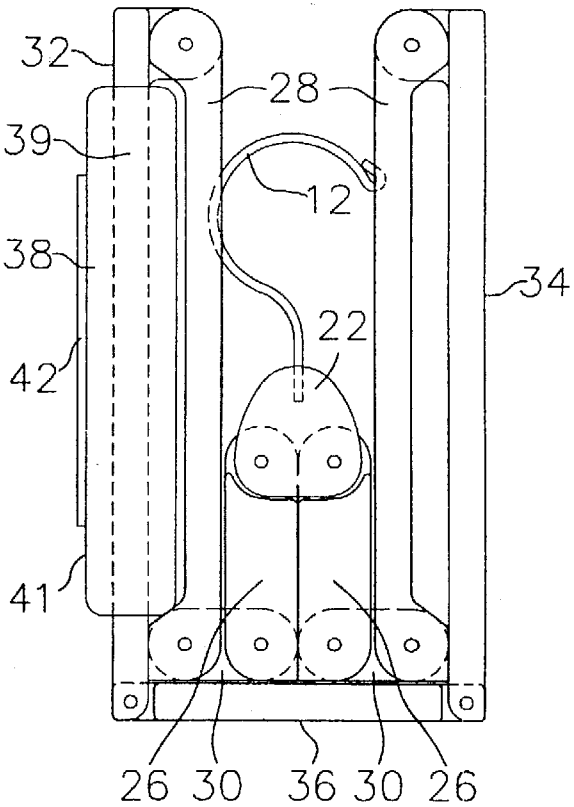
FIG. 6 is a front elevational view of the foldable hanger of FIG. 5 in a fully collapsed state.

Preferably, each upper branch includes a groove 27 formed in an upper side of the second upper section. The slots in the upper branches provide a means for covering the exposed ends of the hook when the hanger is fully collapsed (FIG. 6). Thus, in contrast with the prior art, the hanger 10 may be fully collapsed and folded into a closed compact configuration that prevents the hook from catching or snagging on other objects.

The lower branch 18 includes a first end section 32 pivotally coupled at end 32B to end 28B of one of the upper branches, a second end section 34 pivotally coupled at end 34B to end 28B of the other upper branch, and a middle section 36 positioned between the end sections 32, 34. More particularly, end 32A of the first end section is pivotally coupled to end 35 of the middle section and end 34A is pivotally coupled to end 37 of the middle section.

The hanger 10 also includes a locking member 38 slidably positioned on the lower branch 18 for securing the distinct sections of the lower branch into a rigid bar when the hanger is fully deployed. In the embodiment illustrated in FIGS. 1 and 2, the locking member 38 includes a sleeve provided around the lower branch of the hanger. When aligned over the middle section 36, the sleeve extends over the joints between the middle section 36 and end sections 32, 34 to lock the respective sections of the lower branch into a rigid bar.

Preferably, one of the end sections of the lower branch 18 includes a notch or tab to secure the locking member over the middle section when the hanger is fully deployed.

A prototype of the hanger according to the present invention has been made out of wood. However, it should be noted that the hanger, and any of its distinct components, may be made out of any other suitable material such as thermoplastics, resin-type plastics, metal, or any combination thereof.

Figure 3:
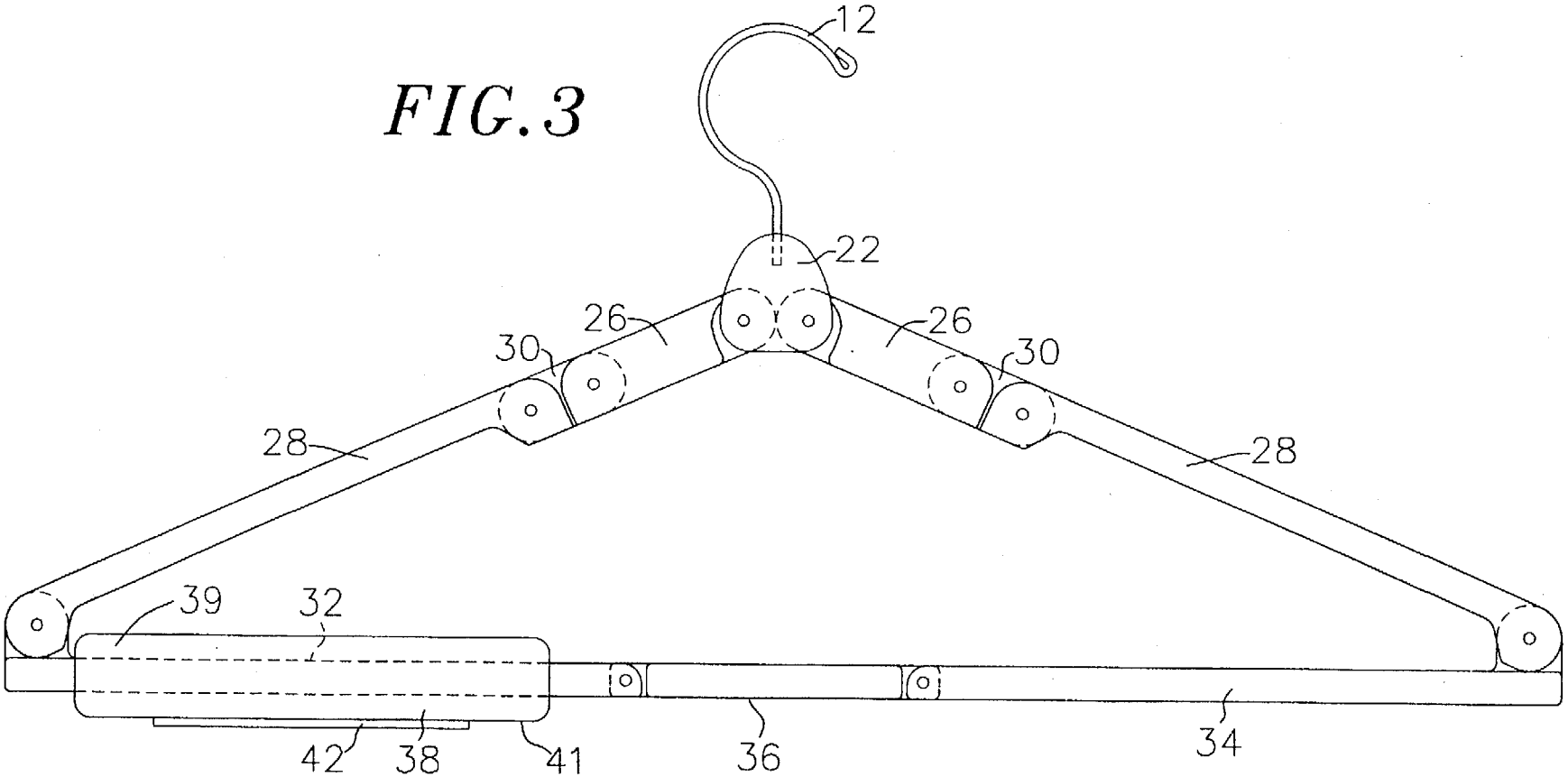
FIG. 3 is a front elevational view of the foldable hanger of FIG. 2 wherein the locking member is positioned on one end of the lower member of the hanger.
Figure 4:
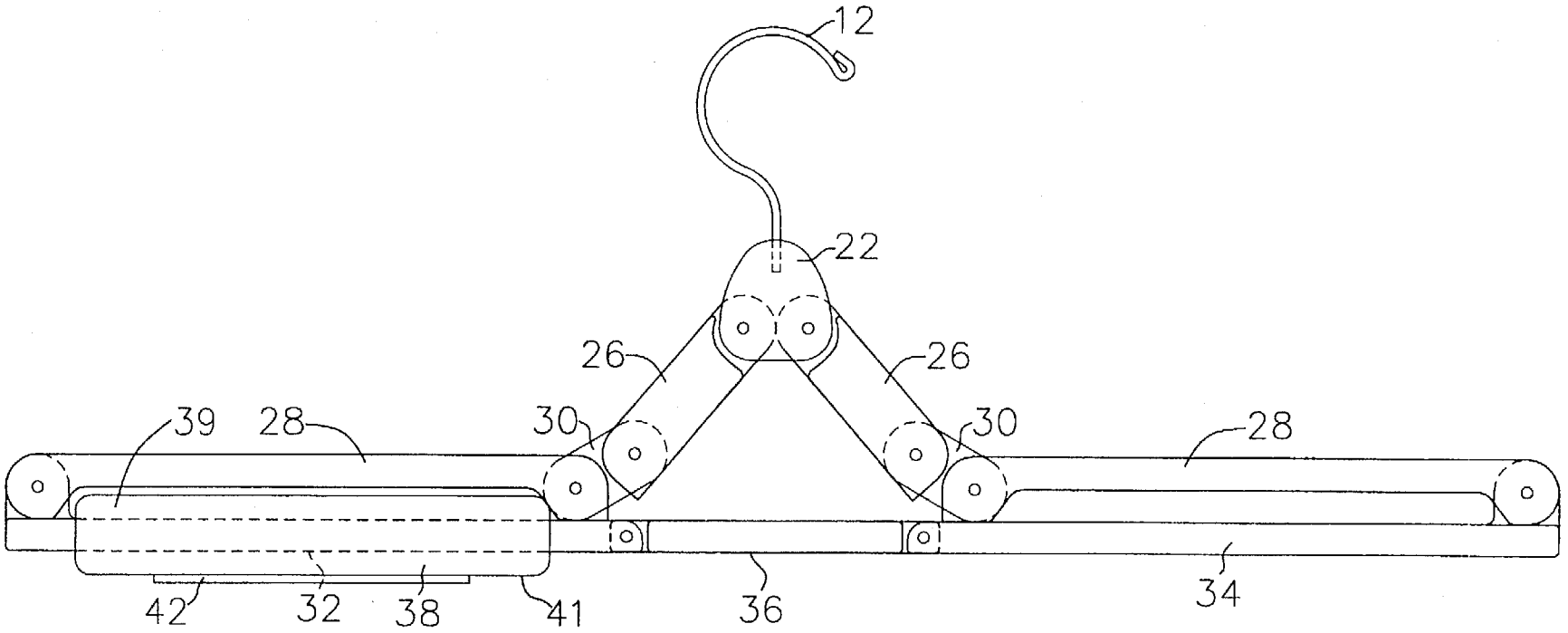
FIG. 4 is a front elevational view of the foldable hanger of FIG. 3 wherein the upper member is collapsed towards the lower member.
Figure 5:
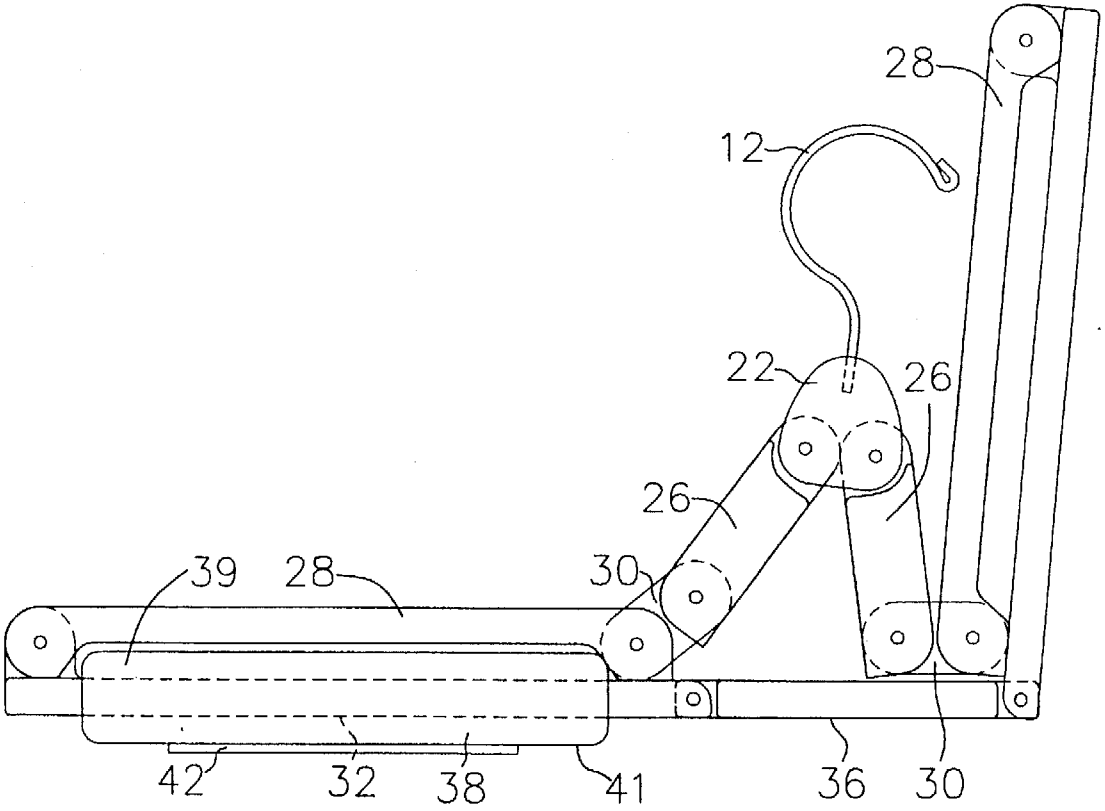
FIG. 5 is a front elevational view of the foldable hanger of FIG. 4 wherein one side of the hanger is folded upwards.

The process of collapsing and folding the hanger is illustrated in various stages in FIGS. 2–6. In FIG. 2, the hanger is illustrated in a fully deployed state. The process begins with sliding the locking member 38 toward one end section of the lower branch 18 of the hanger (FIG. 3). In FIG. 3, the locking section is illustrated as being slid toward the first end section 32, although it may alternatively be slid toward the second end section 34. The second upper members 28 of the upper branches 14, 16 are then pivoted relative to the first upper members 26 and to the lower branch 18, so that both second upper members 28 are substantially parallel with, and adjacent to, end sections 32, 34 (FIG. 4). Next, end section 34 is pivoted relative to the middle section 36 of the lower branch so that it, and the adjacent second upper member 28, are substantially perpendicular to the middle section 36 (FIG. 5). Finally, the other end section 32 is pivoted in a similar manner as the first end section, so that resulting configuration of the fully collapsed and folded hanger 10 is generally U-shaped (FIG. 6). If desired, a combination of tabs and corresponding notches may be formed in adjacent faces of middle section 36 and connectors 30 to secure the hanger in its collapsed and folded state. Additionally, it should be noted that the exposed ends of the hook 12 extend into slots 27 formed in the upper branches when the hanger is fully collapsed and folded, to eliminate the potential problems and dangers associated with an exposed hook.

The process described above is simply reversed in order to deploy the hanger for use from its fully collapsed and folded state.

Figure 7:
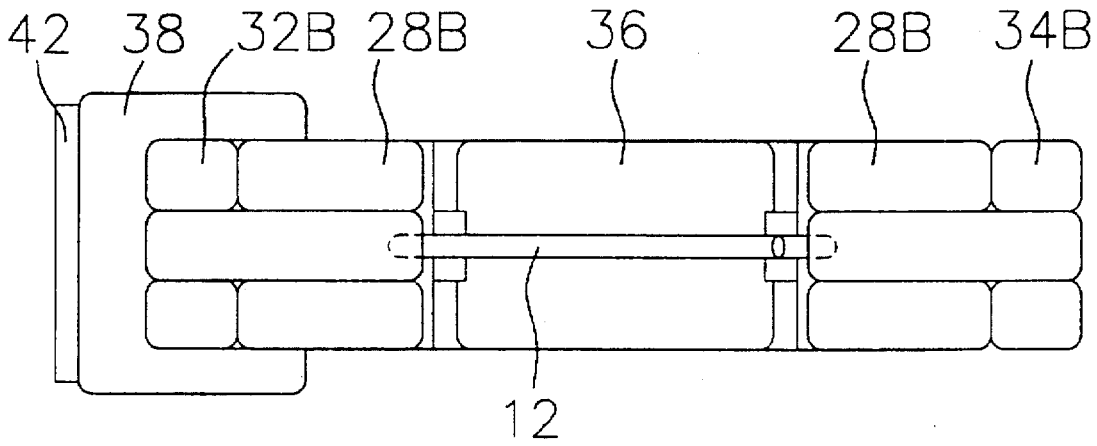
FIG. 7 is a top elevational view of the foldable hanger of FIG. 6.
Figure 8:
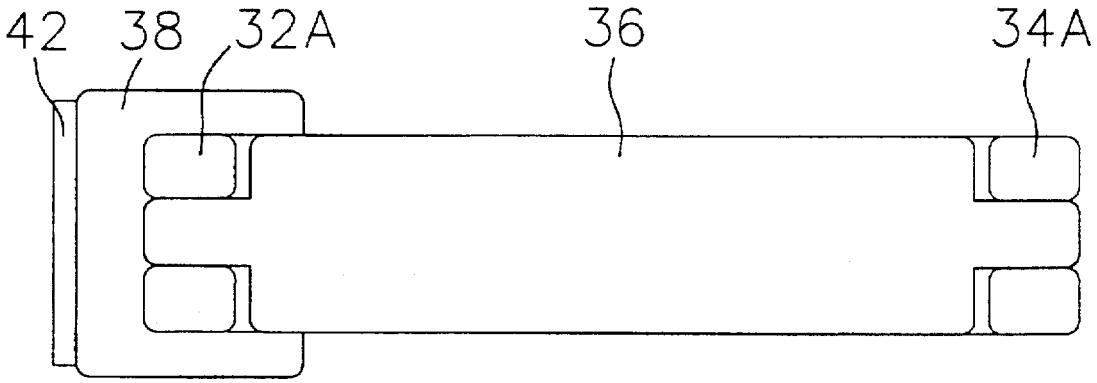
FIG. 8 is a bottom elevational view of the foldable hanger of FIG. 7.

The joints between the respective components may be made by any means well known in the art to provide the necessary pivotal coupling between the components of the hanger. In one embodiment of the present invention, a slot and tab design is used with pinned connections to provide the necessary articulation of the hanger. For example, as can best been seen in FIGS. 7 and 8, end 35 of middle section of the lower branch includes a tab that is fittable into a matching slot formed in end 32A of the first end section; end 32B of the first end section includes a tab, extending vertically away from the component, that is fittable into a matching slot formed in end 28B of the second upper section; connector 30 includes tabs at both ends that are fittable into slots formed in ends 26A and 28A of the first upper and second upper sections, respectively, of the upper branch; and end 26B of the first upper section includes a tab that is fittable into a slot formed in one end of the hub. For all of these joints, a pinned connection is used to provide the necessary pivotally coupling required by the present invention.

The construction of the hanger 10 facilitates the addition of several unique features to the design. For example, side surfaces 39 of the locking member may be used as an advertising medium for carrying a logo or other message. Because the locking member 38 is manipulated in order to operate the hanger, any logo or message on the member would be very noticeable to the user. Additionally, a strip of lint removal material 42 may be attached to a lower surface 41 of the locking member 38. The hanger can then be used as a brush to remove lint when in its collapsed and folded state.

The present invention, therefore, provides an improved foldable and collapsible hanger that provides the strong, rigid construction of a conventional hanger when deployed, yet can be quickly and easily collapsed and folded to fit into virtually any suitcase, briefcase, travel bag, side pocket, glove compartment, etc.

While various embodiments of this invention have been shown and described, it would be apparent to those skilled in the art that many more modifications are possible without departing from the inventive concept herein. For example, the hanger may be deployed or collapsed using a different combination or series of steps than those described above. It is, therefore, to be understood that within the scope of the appended claims, this invention may be practiced otherwise than as specifically described.

What is claimed is:

1. A collapsible hanger comprising:

a central hub;

a hook coupled to the central hub;

a pair of articulated upper branches extending in opposite directions from the central hub;

an articulated lower branch extending between distal ends of the upper branches; and a locking member provided on the lower branch, wherein each of the upper branches includes a first upper section pivotally coupled at a first end to a side of the central hub, a second upper section pivotally coupled at a first end to an end of the lower branch, and a connector positioned between, and pivotally coupled to, the first upper section and second upper section, and wherein the lower branch comprises a first end section pivotally coupled at a first end to the first end of the second upper section of one of the upper branches, a second end section pivotally coupled at a first end to the first end of the second upper section of the other upper branch, and a middle section positioned between, and pivotally coupled to, the first end section and second end section.

2. The collapsible hanger according to claim 1 wherein the locking member includes a sleeve slidably provided around the lower branch.

3. The collapsible hanger according to claim 2 wherein sleeve is longer than the middle section of the lower branch such that when positioned over the middle section, the sleeve extends over the pivotal couplings between the first end section and the middle section and the second end section and the middle section.

4. The collapsible hanger according to claim 1 wherein each of the upper branches includes a groove formed in a upper surface of the upper branch.

5. The collapsible hanger according to claim 1 further comprising means for removing lint provided on an exposed surface of the locking member.

6. The collapsible hanger according to claim 1 further comprising advertising means provided on an exposed surface of the locking member.

7. The collapsible hanger according to claim 1 wherein first end of the each first upper section includes a tab fittable into a slot formed in the central hub.

8. The collapsible hanger according to claim 1 wherein each connector includes a pair of opposed tabs fittable into a slot formed in a second end of the first upper section and a second end of the second upper section, respectively.

9. The collapsible hanger according to claim 1 wherein the first end of the first end section and the first end of the second end section both include a tab fittable into a slot formed in a first end of a respective one of the second upper sections.

10. The collapsible hanger according to claim 1 wherein the middle section includes a pair of opposed tabs fittable into a slot formed in a second end of the first end section and a second end of the second end section, respectively.

11. A foldable garment hanger comprising:

a central hub;

a hook extending from the central hub;

a pair of articulated upper branches pivotally coupled to, and extending in opposite directions from, the central hub, each upper branch having a first joint along its length;

an articulated lower branch pivotally coupled to, and extending between, distal ends of the upper branches, the lower branch having a pair of joints along its length; and a locking member provided on the lower branch for securing the lower branch as a rigid member when placed over the joints of the lower branch, wherein the hanger is collapsed by rotation of the branches around the joints.

12. The collapsible hanger according to claim 11 wherein the locking member includes a sleeve slidably provided around the lower branch.

13. The collapsible hanger according to claim 11 wherein each of the upper branches includes a groove formed in an upper surface of the upper branch for receiving a respective side of the hook when the hanger is collapsed.

14. The collapsible hanger according to claim 11 further comprising means for removing lint provided on an exposed surface of the locking member.

15. The collapsible hanger according to claim 11 further comprising advertising means provided on an exposed surface of the locking member.

16. A collapsible hanger comprising;

a central hub;

a pair of upper branches extending in opposite directions from the central hub;

a lower branch extending between distal ends of the upper branches;

means for articulating each of the upper branches to provide a pair of upper branches each having at least three segments;

means for articulating the lower branch to provide a lower branch having at least three segments and at least two pivoting interior joints; and a single means positionable simultaneously over at two pivoting interior joints of the lower branch to secure the lower branch into a rigid element when the hanger is deployed.

* * * * *